US005457861A

United States Patent [19]

Lloyd

[11] Patent Number: 5,457,861

[45] Date of Patent: Oct. 17, 1995

[54] LOCKING TUBE FOR A BURIAL CASKET

[75] Inventor: Wayne W. Lloyd, Schaumburg, Ill.

[73] Assignee: Reliance Tool and Manufacturing Company, Inc., Elgin, Ill.

[21] Appl. No.: 207,387

[22] Filed: Mar. 7, 1994

[51] Int. Cl.[6] ..... A61G 17/00

[52] U.S. Cl. ..... 27/10; 292/336.3; 292/337; 292/DIG. 53

[58] Field of Search ..... 70/2, 10, 370, 70/451; 292/336.3, 337, DIG. 53

[56] References Cited

U.S. PATENT DOCUMENTS

| | | | |
|---|---|---|---|
| 2,676,479 | 4/1954 | Bethune | 70/181 |
| 2,753,613 | 7/1956 | Baker, Sr. | 292/304 X |
| 2,834,628 | 5/1958 | Paparelli et al. | 292/347 |
| 3,201,165 | 8/1965 | Trudeau | 292/336.3 |
| 3,474,648 | 10/1969 | Trinca | 70/181 |
| 3,623,758 | 11/1971 | Trinca | 292/347 |
| 5,265,923 | 11/1993 | Paddock . | |

*Primary Examiner*—Carl D. Friedman
*Assistant Examiner*—Beth A. Aubrey
*Attorney, Agent, or Firm*—Mathew R. P. Perrone, Jr.

[57] ABSTRACT

A locking device for a rounded wall casket is sealable or weldable to the rounded wall casket, while maintaining the aesthetic appearance of the burial casket due to attaching the locking device from the inside of the casket. The sealable locking device has a curved end, interior cylinder with a threaded portion to provide the mounting structure for locking a casket.

15 Claims, 3 Drawing Sheets

LOCKING TUBE FOR A BURIAL CASKET

This invention relates to a locking tube for a burial casket, and more particularly to a locking tube for a burial casket, which is attachable to a curved wall of the burial casket.

BACKGROUND OF THE INVENTION

A burial casket normally has a base, which can be closed by a top lid. The base is generally an open, hollow, rectangular shape. The open side thereof usually has the greatest length and width when compared to the other sides. With the top lid in sealed relation therewith, the casket is closed.

The top lid is generally hinged on one, long, open side of the base and lockable on the oppositely disposed side. With the lockability, the lid becomes sealed to the base and protects the contents of the burial casket.

The key feature of the sealing comes with the locking of the casket by a lock rod tube extending through a side wall of the body of the casket. The rod includes a threaded portion. The rod is turned by a socket formed therein to receive a turning device.

The socket may be turned by hand or crank to move it and join it to the end of the rod. In this fashion, the end of the rod is locked. The opposite end of the rod has a locking bar with hooklike projections. The hooklike projections enter openings in eyes from the casket lid to lock the casket in the closed position, when the bar is moved outwardly by turning the crank.

The ease of securing the locking mechanism and the rod to a flat wall casket is well known. However, it is difficult to make a proper seal of the locking mechanism to a round wall casket or rounded corner casket or curved wall casket. While round wall casket or rounded corner casket or curved wall casket are mentioned, the terms are substantially interchangeable. Cutting an aperture in that rounded wall combined with the gluing procedure to secure the locking mechanism therein is time consuming and labor intensive.

With the mounting of the locking mechanism in the curved wall, access to the tightening mechanism becomes a problem. The screw must be accessed so that it can turned in order to complete the locking. The curved wall and the mounting difficulty interfere with this required access.

It is also difficult to make such securing actions result in or maintain a proper appearance for the casket. Thus, it is desired to simplify this procedure and achieve the desired results of an aesthetic casket, while retaining the efficiency of locking the casket.

SUMMARY OF THE INVENTION

Among the many objectives of this invention is the provision of the locking device for a rounded wall casket, which is easily secured thereto while maintaining the aesthetic appearance of the casket.

A further objective of this invention is to provide a locking device for a rounded wall casket, which efficiently locks the burial casket as desired.

A still further objective of this invention is to provide a locking device for a rounded wall casket, which is welded to the burial casket.

Yet a further objective of this invention is to provide a locking device for a rounded wall casket, which is sealed to the burial casket.

Also an objective of this invention is to provide a locking device for a rounded wall casket, which may be accessed for locking the burial casket.

Another objective of this invention is to provide a method for securing a lid locking device to a rounded wall casket.

Yet another objective of this invention is to provide a method for welding a lid locking device to a rounded wall casket.

Still another objective of this invention is to provide a method for sealing a lid locking device to a rounded wall casket.

These and other objectives of the invention (which other objectives become clear by consideration of the specification, claims and drawings as a whole) are met by providing a locking device for a rounded wall casket, which is sealable or weldable to the rounded wall casket, while maintaining the aesthetic appearance of the burial casket.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

A locking device for a rounded wall casket can be inserted therein while maintaining the access for tightening and the aesthetic appearance of the rounded wall casket. The locking device is sealable or weldable to the rounded wall casket, while maintaining the aesthetic appearance of the burial casket.

A curved end, interior cylinder with a threaded portion therein provides the mounting structure for locking a casket having a curved edge in a sealable fashion. The interior cylinder is generally mounted inside the burial casket. This curved end interior cylinder can be mounted on the burial casket by a second, exterior curved end cylinder.

The welded lock end tube is accomplished by having a hollow cylinder with a stepped structure inside thereof. The stepped structure provides a large interior diameter at one end of the welded lock end tube and a small interior diameter at the opposing end thereof. An interior step serves to assist the change in diameter.

On the exterior of welded lock end tube can be seen a smooth surface of larger exterior diameter correspondingly positioned with the large interior diameter. An exterior, male threaded portion is correspondingly positioned with the small interior diameter. The taper down from the smooth surface to the male threaded portion is assisted by an exterior step.

The smooth surface of larger exterior diameter can be welded from an interior portion of the casket and prevent a detrimental effect on the outside appearance of the rounded wall casket. With the interior portion having the welded portion on the inside of the casket, it is then possible to insert a tube into the threaded portion. With that tube in the threaded portion an access can be provided to the hex nut which will permit the turning of the tube and the locking of the case lid.

The other type of lock end tube is a clamp tube. The clamp tube includes a pair of clamping tubes having a gasket therebetween. A central tube can proceed down the center of the clamping tubes and lock the tubes together in view of the fact that one of the clamping tubes has a female threaded portion. The female threaded portion receives the male threaded portion of a central tube and the solid portion of the central tube is sufficient to fit through the aperture in a tight configuration.

In a manner similar to the welded tube, the clamp tube includes a hex nut or similar device. The hex nut may be accessed by an appropriate wrench and rotated. This rotation is used to shift the rod into a fixed, captured nut. In this fashion, the outer tube can be locked in place on the rounded wall casket.

Figure 1:
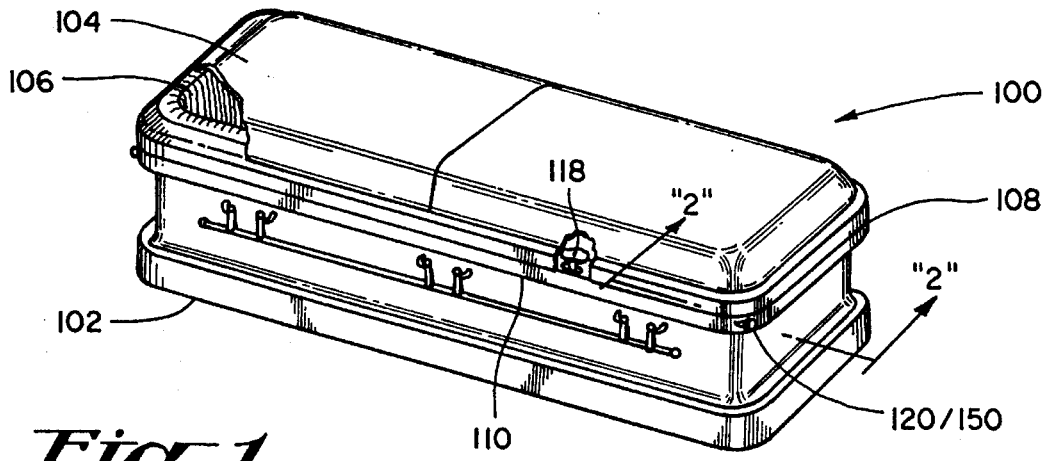
FIG. 1 depicts a perspective view of a burial casket 100 having a locking device of this invention in place.

Referring now to FIG. 1, a round corner, burial casket 100 with a locking device in position is shown. The locking device may be either welded locking device 120 or sealed locking device 150 in place. The burial casket 100 has a base 102 and a lid 104. The base 102 is generally an open, hollow, rectangular shape. The open side 106 thereof usually has the greatest length and width when compared to the other sides. With the top lid 104 in sealed relation therewith, the casket 100 is closed. The top lid 104 is generally hinged on one, long, open side of the base 102 usually called hinged side 108 and lockable on the oppositely disposed locking side 110.

Figure 2:
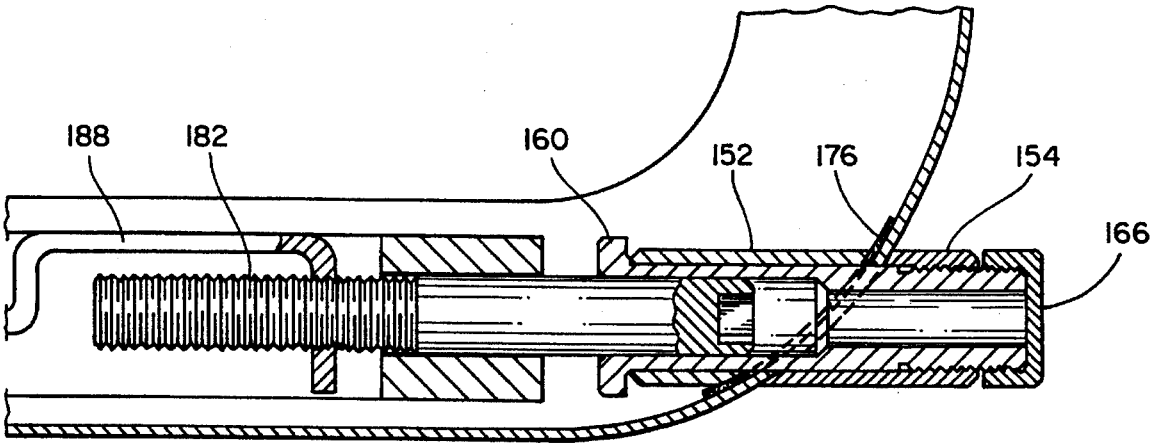
FIG. 2 depicts a partial, cross-sectional view of a lock portion 118 of burial casket 100 having sealed locking device 150 in place along Line 2—2 in FIG. 1.

In FIG. 2, lock portion 118 of burial casket 100 has sealed locking device 150 in place. Sealed locking device 150 has a structure to avoid the welded structure shown in FIG. 10 and FIG. 11.

Figure 3:
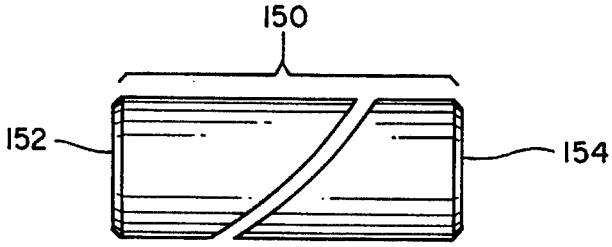
FIG. 3 depicts a side view of sealed locking device 150.
Figure 6:
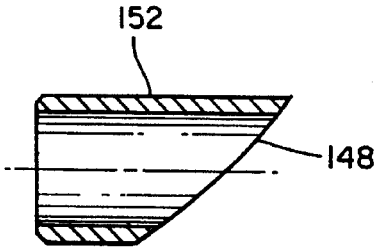
FIG. 6 depicts a side, cross-sectional view of an interior tube 152, which is used to cause the engaging of sealed locking device 150 (shown in FIG. 2) in place.
Figure 7:
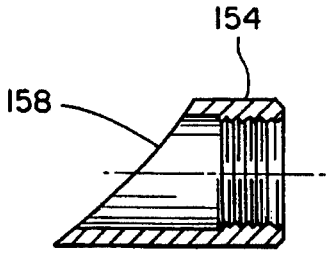
FIG. 7 depicts a side, cross-sectional view of an exterior tube 154, which is used to cause the engaging of sealed locking device 150 (shown in FIG. 2) in place.
Figure 9:
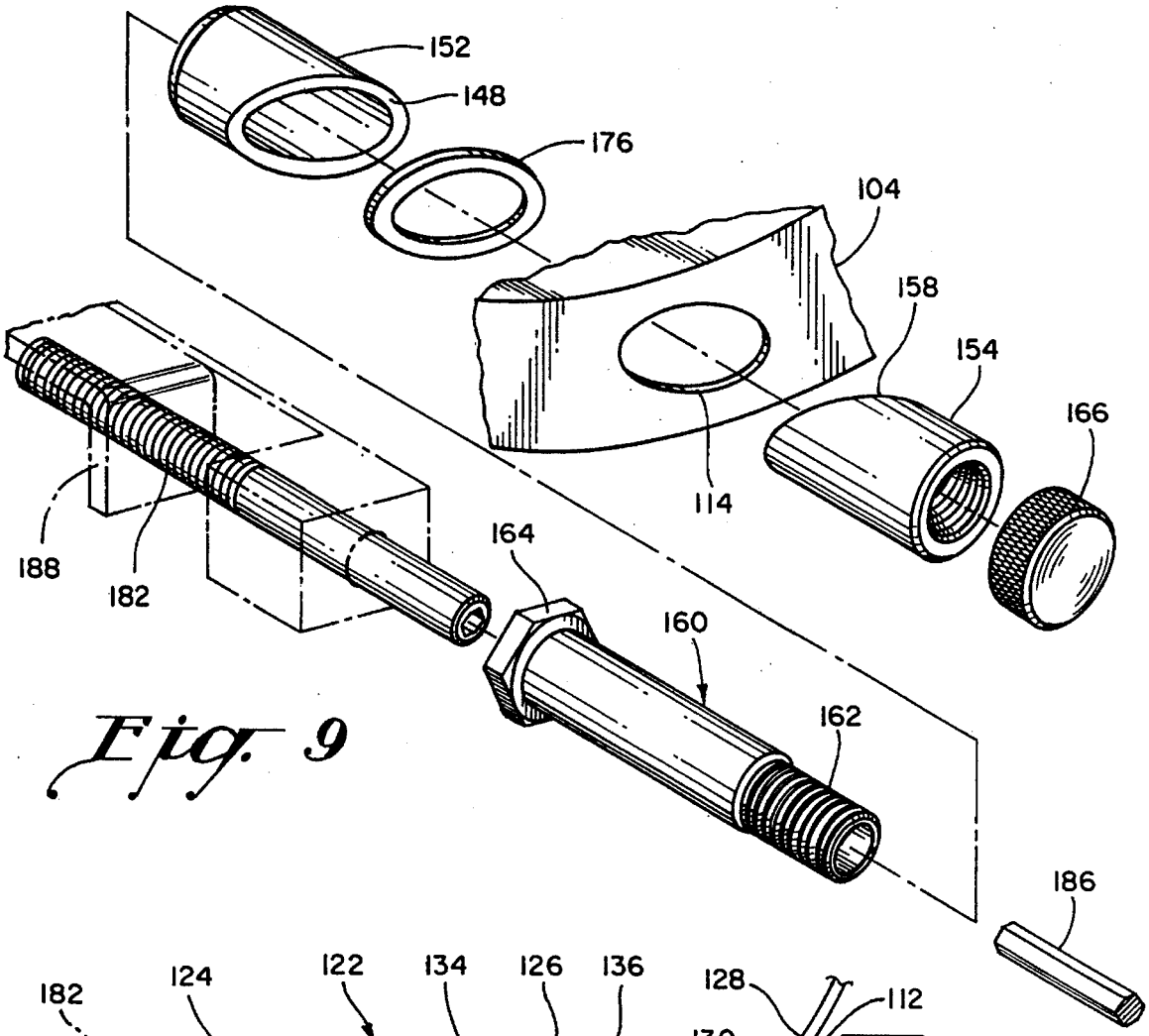
FIG. 9 depicts a perspective, exploded view of sealed locking device 150.

By adding FIG. 3, FIG. 6, and FIG. 7 to this discussion, sealed locking device 150 has an interior tube 152 and an exterior tube 154. Sealed locking device 150 serves the same purpose as welded locking device 120. However, welding is not required. With the perspective exploded view shown in FIG. 9, the structure of the sealed locking device 150 becomes more clear.

At one end of interior tube 152 is an outer arc 148 capable of substantially conforming to the interior corner 128 of burial casket 100. Exterior tube 154 includes a female threaded portion 156 on the interior 158 thereof. Exterior tube 154 abuts aperture 114 on the outside of base 102.

Figure 5:
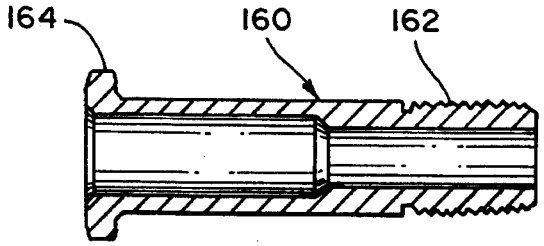
FIG. 5 depicts a side view of hollow member 160, which is used to cause the engaging of sealed locking device 150 (shown in FIG. 2) in place.

In FIG. 5, the hollow internal member 160 for sealed locking device 150 is shown. The hollow internal member 160 is positioned inside the casket 100. Interior tube 152 is slidably mounted thereover. The hollow internal member 160 passes through aperture 114 into exterior tube 154.

The hollow internal member 160 has a male threaded portion 162 at one end thereof capable of engaging female threaded portion 156. Oppositely disposed from the female threaded portion 156 is a nut 164 secured, molded or otherwise formed in hollow internal member 160, which is used to cause the engaging of sealed locking device 150 in place.

Exterior tube 154 has a flat end 170 at one end thereof and abuts aperture 114 on the outside of base 102 at the oppositely disposed arc end 172. Sealed locking device 150 thus surrounds casket aperture 114. A flexible seal 176 may be placed around casket aperture 114 at arc end 172 or outer arc 156.

Figure 8:
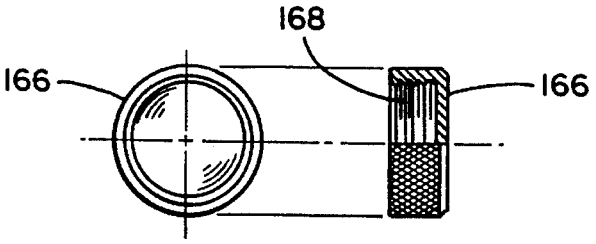
FIG. 8 depicts a combined end view and side, partially cross-sectional view of a threaded cap 166 for sealed locking device 150 (shown FIG. 2) in place.

A threaded cap 166 is shown in both FIG. 2 and FIG. 8 for closing sealed locking device 150. FIG. 8 shows a side partially cross-sectioned view and an internal view of cap 166 showing female cap threads 168 capable of engaging male threaded portion 162 if desired. Threaded cap 166 is an for both sealed locking device 150 and welded locking device 120.

Referring back to FIG. 1, exterior tube 154 may be used with the welded locking device 120. Exterior tube 154 may fit over the male threaded portion 136 to hold smooth surface 134 in position while the welding takes place.

Figure 10:
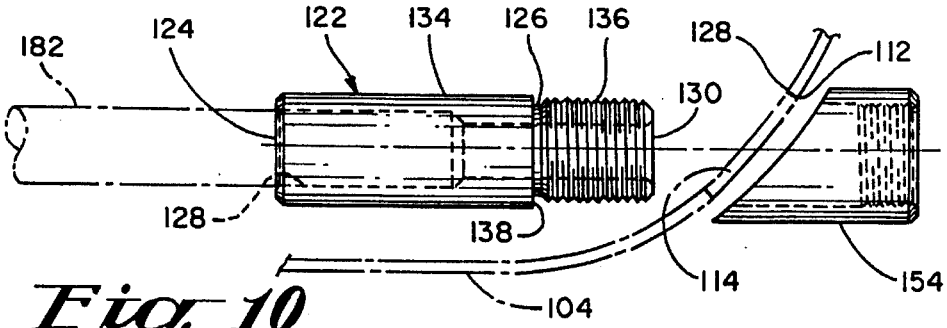
FIG. 10 depicts a side, exploded view of welded locking device 120.
Figure 11:
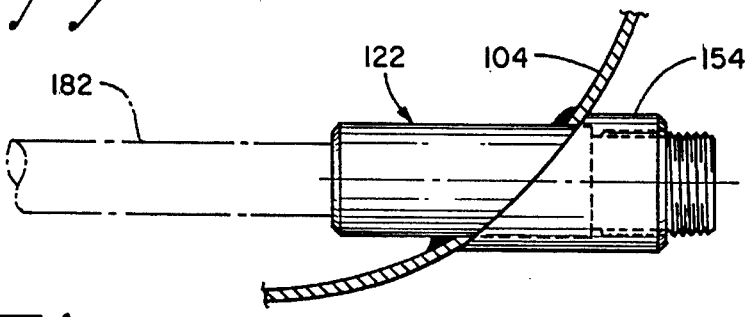
FIG. 11 depicts a side, assembled view of welded locking device 120.

Adding FIG. 10 and FIG. 11 to the consideration, the welded locking device 120 includes a welded lock end tube 122. The welded lock end tube 122 is formed by having a hollow cylinder 124 with an interior stepped structure 126 inside thereof. The stepped structure 126 provides a large interior diameter 128 at one end of the welded lock end tube 122 and a small interior diameter 130 at the opposing end thereof. The interior stepped structure 126 serves to assist the change in interior diameter for the hollow cylinder 124. This stepped structure 126 also appears in hollow internal member 160 as shown in FIG. 5.

The exterior of welded lock end tube 122 permits welding of the tube at an interior corner 132 of casket 100. At one end thereof can be seen a smooth surface 134 of larger exterior diameter correspondingly positioned with the large interior diameter 128.

An exterior, male threaded portion 136 is correspondingly positioned with the small interior diameter 130. The taper down from the smooth surface 134 to the male threaded portion 136 is assisted by an exterior step 138.

The smooth surface 134 of larger exterior diameter can be welded from an interior portion at interior corner 128 of the casket 100 and prevent a detrimental effect on the outside appearance of the rounded wall casket 100. With the welded lock end tube 122 having the welded portion on the inside of the casket 100, it is then possible to insert a tube 138 into the threaded portion 136. With that tube 138 in the threaded portion 136, an access can be provided to the allen hex nut 140, which will permit the turning and the locking of the case lid 104.

There is the male threaded portion 136 at one end thereof exterior to the casket 100. The male threaded portion 136 deviates from the otherwise smooth surface 134. Smooth surface 134 fits through an appropriate casket aperture 114. Thus it provides a guide for locking casket 100.

Smooth surface 134 can be welded to an interior portion of the casket 100 at interior corner 128 and prevent a detrimental effect on the outside corner 112 of the rounded wall casket 100. The appropriate aperture 114 may be cut or otherwise formed in the outside corner 112.

Figure 4:
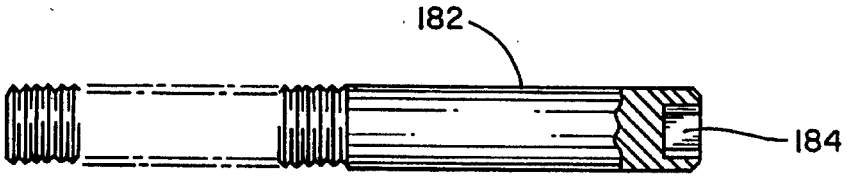
FIG. 4 depicts a side a lock rod tube in the form of threaded tube 182 which is accessed by the locking device of this invention.

Also referring back to FIG. 2, FIG. 4 and FIG. 9, the round corner lock assembly 180 for casket 100 is depicted to the extent required to define this invention. Round corner lock assembly 180 includes a lock rod tube in the form of threaded tube 182 having a socket or wrench receiver 184 in the end thereof and adjacent to either welded locking device 120 or sealed locking device 150.

As wrench 186 passes from the outside of casket 100 through either welded locking device 120 or sealed locking device 150, it engages wrench receiver 184 so that threaded tube 182 may be rotated. Such rotation causes locking bar 188 to move and lock a casket 100. As a typical casket locket mechanism is thoroughly discussed in U.S. Pat. No. 5,265,923, incorporated herein by reference, no further discussion thereof is necessary.

Both welded locking device 120 in place and sealed locking device 150 provide an efficient locking for lock portion 118 of burial casket 100. Due to the fewer parts and unexposed welding, welded locking device 120 is preferred as the most efficient manner of locking the casket 100.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A sealed locking tube for a burial casket, the locking tube being attachable to a curved wall of the burial casket, comprising:

a) the locking tube having a housing, an interior cylinder and an exterior cylinder;

b) the interior cylinder being on the interior of the casket;

c) the exterior cylinder locatable on the exterior of the casket;

d) the locking tube receiving the interior cylinder and the exterior cylinder to mount the locking tube on the casket;

e) the exterior cylinder having an exterior casket end to abut an exterior portion of the casket;

f) the interior cylinder having an interior casket end to abut an interior portion of the casket;

g) the housing being a hollow tubular member;

h) the housing having a male, threaded member locatable on the exterior of the casket;

i) the housing having a stop means to hold the interior cylinder oppositely disposed from the male, threaded member and locatable on the interior of the casket; and j) the exterior cylinder having a female, threaded portion to cooperate with the male, threaded member to hold the locking tube in proper position on the casket.

2. The locking tube of claim 1 further comprising:

a) the exterior casket end having an arcuate shape to abut the curved wall on the exterior portion of the casket; and b) the interior casket end having an shape to abut the curved wall on the interior portion of the casket.

3. The locking tube of claim 1 further comprising a gasket locatable between the exterior casket end and the curved wall.

4. The locking tube of claim 1 further comprising a gasket being between the interior casket end and the curved wall.

5. The locking tube of claim 1 further comprising a securing means in an end of the male, threaded member.

6. The locking tube of claim 5 further comprising the securing means being a wrench receiving means.

7. A weldable locking tube for a burial casket, the locking tube being attachable to a curved wall of the burial casket, comprising:

a) the locking tube having a housing and an exterior cylinder;

b) the housing having a first end locatable inside the casket and a second end locatable on the exterior of the casket;

c) the exterior cylinder locatable on the exterior of the casket;

d) the locking tube receiving the exterior cylinder;

e) a securing means adapted to join the housing on an interior portion of the casket;

f) the housing being a hollow tubular member;

g) the housing having a male, threaded member locatable on the exterior of the casket;

h) the securing means being a welded portion; and i) the exterior cylinder having a female, threaded portion to cooperate with the male, threaded member to hold the locking tube in proper position on the casket.

8. The locking tube of claim 7 further comprising:

a) the exterior casket end having an arcuate shape to abut the curved wall on the exterior portion of the casket; and b) the interior casket end having an shape to abut the curved wall on the interior portion of the casket.

9. The locking tube of claim 7 further comprising a gasket locatable between the exterior casket end and the curved wall.

10. A method of securing a locking tube for a burial to a curved wall of the burial casket, the burial casket having a locking device and the locking tube providing access to the locking device, comprising:

a) forming an aperture in the curved wall to communicate with the locking device;

b) providing a housing for the locking tube;

c) securing the housing in the aperture, a first portion of the housing being on an exterior portion of the casket and a second portion of the housing being on an interior portion of the casket;

d) providing access to the locking device through the housing;

e) the first portion of the housing having a stop means thereon; and f) the second portion of the housing having a male threaded portion thereon;

g) slidably mounting an interior cylinder on the housing, the interior cylinder having a first end adjacent the stop means and a second end adjacent the casket; and h) securing an exterior cylinder to the housing in threaded relation therewith at the male threaded portion.

11. The method of claim 10 further comprising:

a) the interior cylinder having the second end arced to conform to the casket; and b) the exterior cylinder having a female threaded end and an opposing end arced to conform to the casket.

12. The method of claim 10 further comprising a wrench receiving member at an exposed end of the male threaded portion.

13. The method of claim 10 further comprising:

a) securing the housing by welding on the interior portion of the casket; and b) securing an exterior cylinder to the housing in threaded relation therewith at the male threaded portion.

14. In a round corner, burial casket having a base and a lid; the base being an open, hollow, rectangular shape with open side; the lid serving to close the open side; and a locking device to secure the lid to the base; the improvement comprising:

a) a locking tube having a housing and an exterior cylinder secured thereto;

b) an aperture in a round corner of the casket to provide access to the locking device;

c) the housing being a hollow tubular member;

d) the exterior cylinder being on the exterior of the casket;

e) the housing having an interior portion on an interior of the casket and an exterior portion on the exterior of the casket;

f) the locking tube having an interior cylinder;

g) the interior cylinder being on the interior of the casket;

h) the exterior cylinder being on the exterior of the casket;

i) the housing tube receiving the interior cylinder and the exterior cylinder to mount the locking tube casket;

j) the exterior cylinder having an exterior casket end to abut an exterior portion of the casket;

k) the interior cylinder having an interior casket end to abut an interior portion of the casket;

l) the housing having a male, threaded member on the exterior of the casket;

m) the housing having a stop means on the interior of the casket opposite the male, threaded member on the exterior of the casket to hold the interior cylinder;

n) the exterior cylinder having a female, threaded portion to cooperate with the male, threaded member to hold the locking tube in proper position on the casket;

o) the exterior casket end having an arcuate shape to abut the curved wall on the exterior portion of the casket; and p) the interior casket end having an shape to abut the curved wall on the interior portion of the casket.

15. The round corner, burial casket of claim 14 further comprising:

a) the exterior cylinder being on the exterior of the casket;

b) the housing receiving the exterior cylinder;

c) a securing means joining the housing on an interior portion of the casket;

d) the housing having a male, threaded member on the exterior of the casket;

e) the securing means being a welded portion;

f) the exterior cylinder having a female, threaded portion to cooperate with the male, threaded member to holding the locking tube in proper position on the casket and an exterior casket end;

g) the exterior casket end having an arcuate shape to abut the curved wall on the exterior portion of the casket; and h) the interior casket end having an shape to abut the curved wall on the interior portion of the casket.

* * * * *